US005826771A

United States Patent [19]

Peng

[11] Patent Number: 5,826,771

[45] Date of Patent: Oct. 27, 1998

[54] BACK PACK FOR IN LINE SKATES

[76] Inventor: Stephen Peng, 500 W. Flagler St., Miami, Fla. 33130

[21] Appl. No.: 806,687

[22] Filed: Feb. 26, 1997

[51] Int. Cl.[6] ..... A45F 3/04

[52] U.S. Cl. ..... 224/651; 244/645; 244/652; 244/680

[58] Field of Search ..... 244/651, 652, 244/645, 637, 627, 680

[56] References Cited

U.S. PATENT DOCUMENTS

| | | | |
|---|---|---|---|
| D. 202,403 | 9/1965 | Craig . | |
| D. 287,548 | 1/1987 | Kraynack-Simon . | |
| D. 308,602 | 6/1990 | St. Pierre . | |
| D. 333,038 | 2/1993 | Collins . | |
| D. 367,173 | 2/1996 | Trihus | D3/317 |
| 4,126,256 | 11/1978 | McGruder . | |
| 4,884,731 | 12/1989 | Sibley | 224/651 |
| 5,370,287 | 12/1994 | Cormier . | |
| 5,465,887 | 11/1995 | Hudson | 224/651 |
| 5,509,589 | 4/1996 | Kliot | 224/637 |
| 5,540,364 | 7/1996 | Krieger et al. . | |
| 5,564,539 | 10/1996 | Duensing | 224/645 X |
| 5,573,166 | 11/1996 | Leja | 224/651 X |

*Primary Examiner*—Renee S. Luebke
*Attorney, Agent, or Firm*—Richard C. Litman

[57] ABSTRACT

A back pack for in-line skates includes a relatively large central compartment having a lateral shape in section somewhat resembling that of an in-line skate or ice skate with its integral boot. The sides of the central compartment include fixed loops and openable adjustable straps for removably securing one of a pair of skates to each side. The back of the central compartment includes a removable and adjustable helmet retaining net, providing for the removable retention of an in-line skating helmet or the like externally on the back of the pack. Additional smaller bottom, lower rear, and upper storage compartments may be removably or permanently attached to the central compartment. The pack includes adjustable padded shoulder strap loops extending from the upper front to the lower front of the central compartment, and a padded hip support belt extending from one side to the other across the front of the lower compartment. The pack thus provides for the external carriage of relatively large and bulky articles used in skating, such as the skates and helmet, while also providing for the internal carriage and storage of other associated equipment, such as knee and elbow guards, maintenance and repair equipment for the skates, and perhaps a change of clothing or other articles as desired.

18 Claims, 4 Drawing Sheets

BACK PACK FOR IN LINE SKATES

BACKGROUND OF THE INVENTION

1. Field of the Invention

The present invention relates generally to equipment for the carriage of articles, and more specifically to a back pack which is especially adapted for the carriage of equipment used in in-line skating activities. The pack includes means for the external carriage of a pair of in-line skates (a particular brand of which is known as ROLLERBLADES), a helmet, and other assorted articles, such as protective clothing, knee and elbow guards, etc.

2. Description of the Prior Art

Skating has long been popular as a form of recreation and exercise, dating back to the development of the ice skate in centuries past. Advances in technology, including smooth and hard paving, led to the development of the roller skate, having four wheels (or eight wheels in four pairs), placed in a rectangular pattern beneath each skate. Later, the in-line skate (a certain type of which is known by the trade name ROLLERBLADE tm) was developed, in which all of the skate wheels are coplanar and disposed in a single longitudinal line beneath the skate.

All of the above described skates have some things in common such as their unsuitability for use except in the proper conditions and environment (ice, smooth and unobstructed pavement, etc.) and in the case of wheeled skates, the generally accepted need for additional safety equipment (helmet, knee and elbow guards, etc.). Thus, the conveyance of the skates, along with the additional articles of safety equipment, to a skating site may be a rather cumbersome undertaking, considering the bulk of such equipment.

Many persons utilize a conventional back pack for such purpose, loading their skates and other equipment internally within the pack. However, the hard metal components of the skates, such as roller skate wheels, metal sole plate edges, etc., can lead to damage to other components carried therewith, unless additional space is used for the packing of padding to separate such articles. Even so, the equipment carried in such a general purpose back pack is often difficult to pack properly and to retrieve from the pack, due to the lack of special purpose storage and retaining means for the specially configured skates and equipment.

Accordingly, a need arises for a back pack for in-line skates, comprising a back pack with means for the external securing and carriage of a single skate of a pair of skates on opposite sides thereof. Means for the carriage of a helmet is provided externally on the back of the pack, and various internal storage areas are provided for the carriage of additional equipment, clothing, etc. A discussion of the prior art of which the inventor is aware, and its differences from the present invention, is provided below.

U.S. Pat. No. 4,126,256 issued on Nov. 21, 1978 to Jerome McGruder describes a Carrier Case For Ice Skates, Roller Skates, Boots And Shoes. The device is actually two separate compartments, one for the internal carriage of each skate or boot, with the compartments permanently joined at their upper edges by a flexible connector. The device does not provide for the internal carriage of other accessories or equipment; does not provide a plurality of contiguous storage compartments; does not include shoulder strap loops to secure the carrier about both shoulders of the user; and does not provide for the external carriage of skates, a helmet, or any other equipment for that matter, all of which features are provided by the present back pack.

U.S. Pat. No. 4,884,731 issued on Dec. 5, 1989 to Paul T. Sibley describes a Backpack With Detachable Auxiliary Packs, wherein the pack is adapted for the removable attachment of an elongate auxiliary pack to each side thereof. However, the strap attachment means for the auxiliary packs is not positioned properly for the securing of articles having a roughly L-shaped form, such as an in-line skate or ice skate, as provided by the present pack. Moreover, Sibley fails to provide any retaining means for the external carriage of a helmet on the back of the pack, as provided by the present invention. Sibley clearly does not anticipate the carriage of such oddly shaped articles as skates and a helmet, and provides no specialized means of carrying such articles using his pack.

U.S. Pat. No. 5,370,287 issued on Dec. 6, 1994 to Odilen A. Cormier describes a Divisible Backpack, having two portions divisible by a zipper about their common peripheries. The first portion is a generally flat, planar, padded structure adapted for use as a seat cushion. The second portion includes a generally hemispherical internal volume, with the second portion thus roughly resembling a billed cap. While the hemispherical volume may be suitable for the carriage of a helmet internally, no means is provided for the external carriage of such an article, nor for the carriage either internally or externally of any articles having a generally L-shaped form, such as in-line or ice skates, as provided by the present invention.

U.S. Pat. No. 5,509,589 issued on Apr. 23, 1996 to Eugene Kliot describes a Back Pack For Heavy Bulky Footwear, comprising a tapered fabric container having a single access panel therefor. The internal volume is divided into three separate containers, each accessible from the single access panel. The two container portions to each side of the center are adapted for the carriage of skates internally within the pack, with the central container portion providing for the carriage of a helmet internally therein. However, once these articles are placed within the Kliot pack, no room remains for the carriage of other articles, such as knee and elbow guards, etc., which are often required for skaters in certain regulated areas set aside for such use. The present invention carries the skates and helmet externally, to leave the internal volume of the present pack available for such additional equipment.

U.S. Pat. No. 5,540,364 issued on Jul. 30, 1996 to Julian Z. Krieger et al. describes an Article Carrier having a hip support belt and detachable back portion with shoulder straps extending from an integral "fanny pack" permanently secured to the belt portion. Numerous straps on the back portion provide for the removable attachment of other articles (e. g., a back pack) thereto. However, no means is provided for the external carriage of a skate on opposite sides of a central back pack container, nor for the external carriage of a helmet on such a back pack container, as provided by the present invention.

U.S. Pat. No. D-202,403 issued on Sep. 21, 1965 to Floyd W. Craig illustrates a design for a Boot Bag, having an external shape roughly resembling the form of the main container portion of the present back pack, but devoid of any means for the external attachment of other articles, such as skates and a helmet, thereto. Moreover, Craig does not appear to provide shoulder straps or a hip support belt with his design, both of which features are a part of the present invention.

U.S. Pat. No. D-287,548 issued on Jan. 6, 1987 to Therese M. Kraynack-Simon illustrates a design for a Roller Skate Case, having an external shape resembling a single roller skate and integral boot. No means providing for the external carriage of skates, helmet, and/or other articles are apparent. No shoulder straps appear to be provided; only a single carrying handle strap is shown.

U.S. Pat. No. D-308,602 issued on Jun. 19, 1990 to Janet St. Pierre illustrates a design for Soft Luggage, having a generally rectangular solid central portion with somewhat boot-shaped opposite lateral compartments. A separate, somewhat truncated cylindrical compartment is attached to one end of the central portion, with opposite handle straps extending from the central portion. No means for the external carriage of skates, helmet, and/or any other articles is apparent, and no shoulder straps appear to be disclosed, all of which are provided by the present invention.

U.S. Pat. No. D-333,038 issued on Feb. 9, 1993 to Greg Collins illustrates a Hockey Equipment Bag having a truncated rectangular shape and including a smaller, rearwardly disposed container thereon. No means is apparent for the external carriage of skates, helmet, and/or other articles, nor is any hip support belt apparent in the Collins design, each of which features are provided by the present invention.

Finally, U.S. Pat. No. D-367,173 issued on Feb. 20, 1996 to Timothy N. Trihus illustrates a design for an In-Line Skate Knapsack having a lateral cross sectional shape roughly resembling a skate and integral boot. No means for the external carriage of articles, such as skates and a helmet, are apparent in the Trihus design, and only a single compartment is apparent, accessible by a zipper on each side of the compartment.

None of the above inventions and patents, either singly or in combination, is seen to describe the instant invention as claimed.

SUMMARY OF THE INVENTION

The present invention comprises a back pack for in-line skates (e. g., Rollerblades, tm), ice skates, or the like, and provides for the external carriage of such skates and a helmet thereon. The pack includes a relatively large central compartment accessible by an upper closure, with the central compartment having a lateral shape in section somewhat like that of a relatively bulky in line skate or ice skate with integral boot or shoe. A generally diagonal fixed retaining strap is provided on each side of the central compartment, with a plurality of adjustable straps extending generally across the fixed strap to secure one of a pair of skates removably to each side of the central compartment. A helmet may be secured externally to the back of the central compartment by a retaining net which is adjustably secured thereto.

Auxiliary compartments, such as a bottom compartment, a lower rear compartment, and an upper compartment, may be secured either removably or permanently to the central container portion of the pack, if so desired. Adjustable padded shoulder strap loops are provided, extending from the upper front to the lower front of the pack, and a padded hip support belt extends across the lower front portion of the pack, from one side to the other. The relatively large central compartment, along with the smaller auxiliary compartments, provide for the storage and carriage of other articles, such as knee and elbow guards, skate maintenance and repair equipment, a change of clothing, etc., as desired.

Accordingly, it is a principal object of the invention to provide an improved back pack for in-line skates, including at least a central storage compartment and means for the external carriage and retention of a pair of skates and a helmet thereon.

It is another object of the invention to provide an improved back pack for in-line skates, which central storage compartment has a generally L-shaped lateral section, generally congruent with the shape of an in-line skate and integral boot, and including external strap means for securing one of a pair of skates to each side of the central compartment.

It is a further object of the invention to provide an improved back pack for in-line skates which helmet retaining means comprises an adjustable and detachable circular net which is securable over a helmet on the back of the central compartment.

An additional object of the invention is to provide an improved back pack for in-line skates including padded shoulder straps and a padded hip support belt, and which may also include smaller supplementary compartments either permanently or removably attached to the central compartment.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
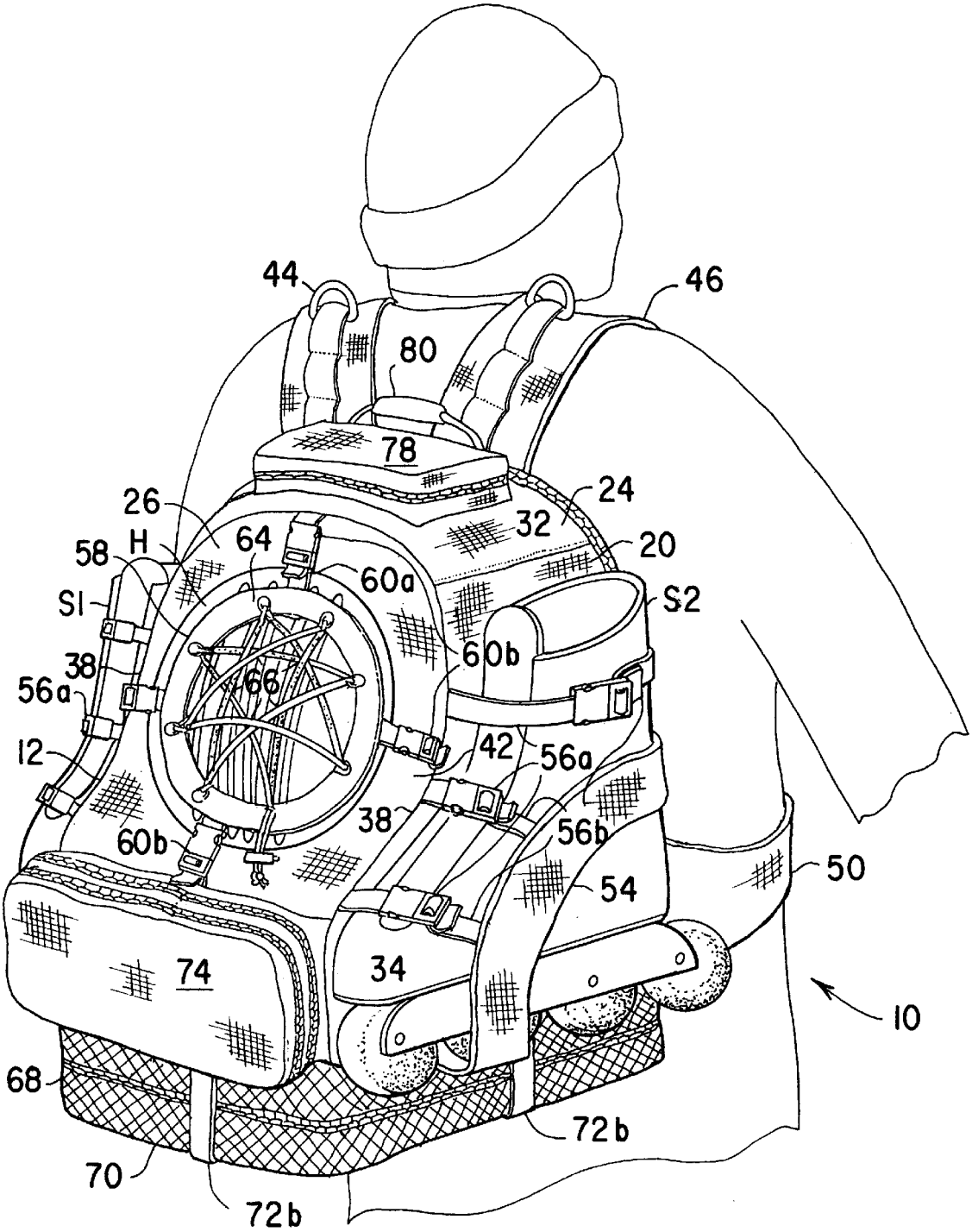
FIG. 1 is a rear perspective view of the present back pack for in line skates, showing the external securing of a pair of in-line skates and a helmet thereto, as well as other features.

The present invention comprises a back pack 10 particularly adapted for use with and for the external carriage of a pair of in-line skates S1 and S2, and a helmet H typically worn by a skater while skating, as shown generally in FIG. 1. It should be noted that while the present pack 10 is particularly well suited for use with in-line skates, e. g., Rollerblades (tm), that it is also well suited for the external carriage of other types of skates having a relatively narrow support portion, such as the long and narrow blade of an ice skate. Normally, ice skates are provided with blade guards which are removably installed over the edges of the blades when the skates are not in use, and so the present pack 10, with its pliable fabric materials, may be readily used with ice skates.

Figure 3:
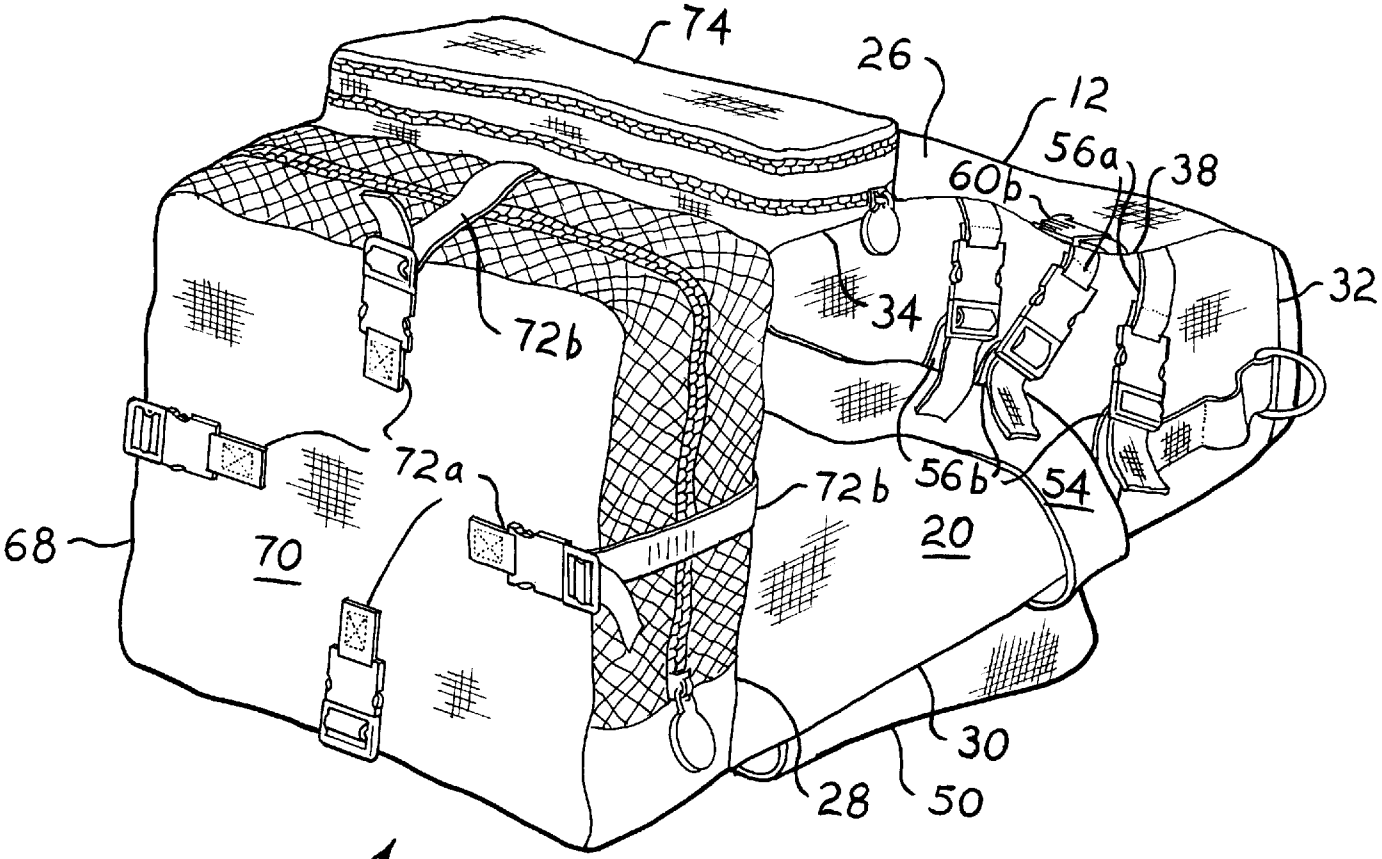
FIG. 3 is a bottom perspective view, showing the lower compartment and removable attachment means therefor.
Figure 4:
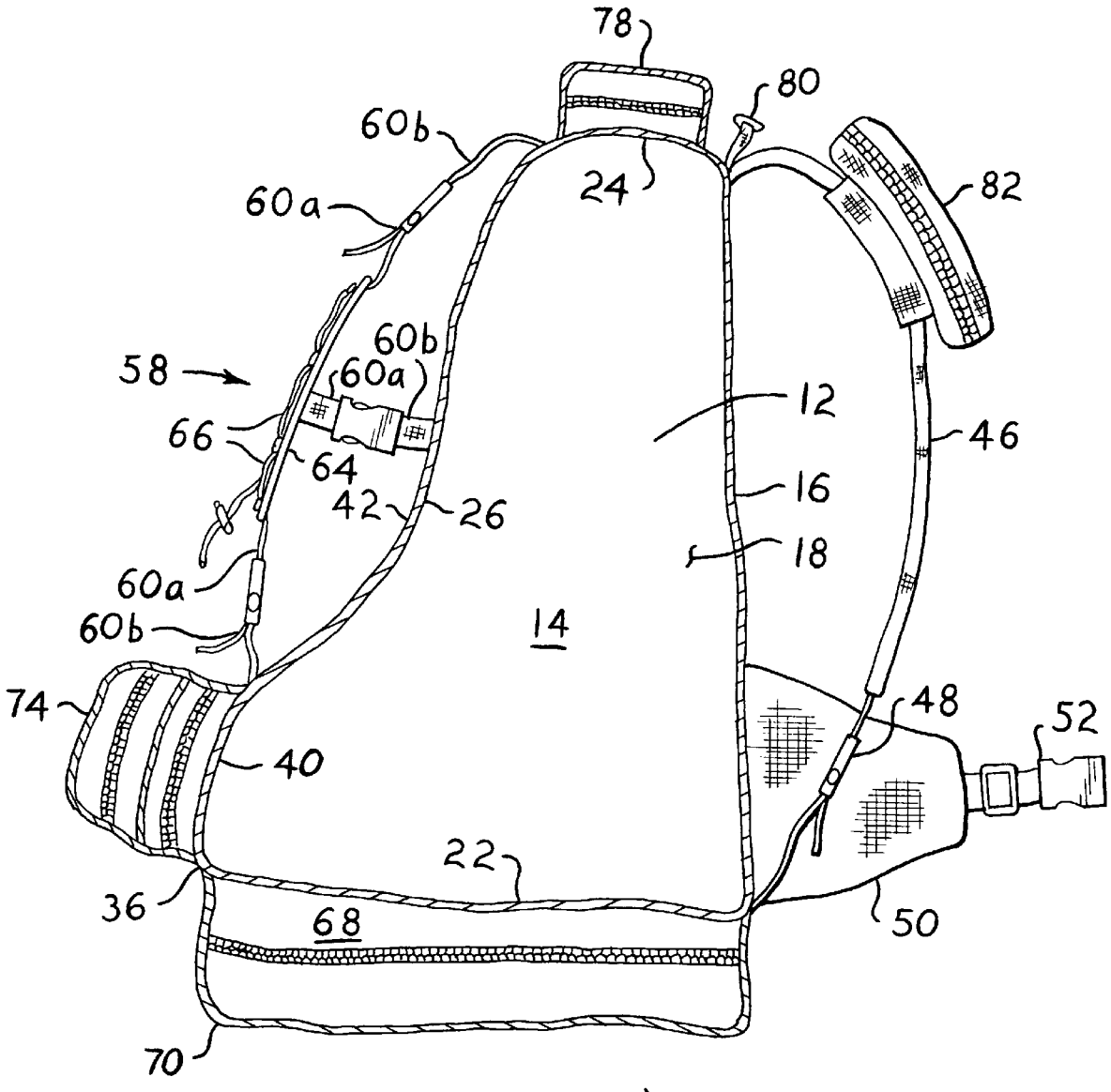
FIG. 4 is a side elevation view in section of the present back pack, showing the various compartments thereof.

The pack 10 includes a relatively large central compartment 12, having an accessible internal volume 14 (as shown in FIG. 4) defined by a front wall 16 (FIG. 4), a first and an opposite second side wall 18 and 20, a bottom wall 22 (FIGS. 3 and 4), a top wall 24 opposite the bottom wall 22, and a rear wall 26 opposite the front wall 16. The central compartment 12 is preferably configured generally in an L-shape when viewed from the side, as the lateral view in section in FIG. 4 clearly shows. Such a configuration allows the conventional approximate L-shape of each of the skates S1 and S2, with their elongate foot portions and upwardly extending upper portions, to be accommodated more efficiently along the sides of the pack 10, where they may be stored and carried externally as shown in FIG. 1.

Figure 2:
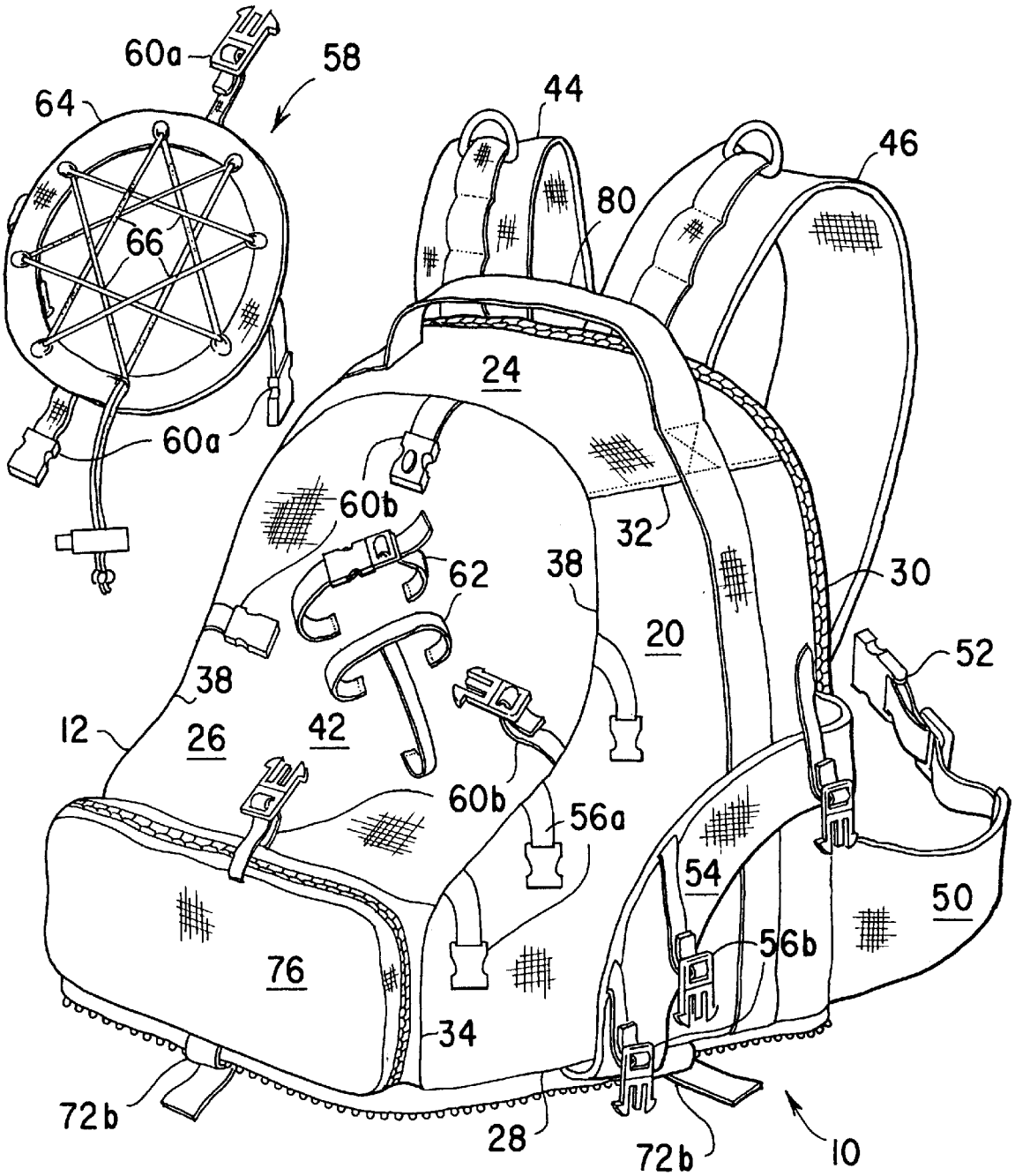
FIG. 2 is a rear perspective view of the present back pack, showing the pack with the skates and helmet retaining net removed.

Thus, each side wall 18 and 20 has a generally straight bottom edge 28 and forward edge 30 (FIG. 2). The top forward edge 32 and lower rear edge 34 of each side wall 18 and 20 are relatively short, with the rear wall 26 extending diagonally downwardly and rearwardly from the top panel 24 to the rearward edge 36 (FIG. 4) of the bottom wall 22. The upper rear edge 38 of each side wall 18 and 20 has a somewhat concave shape extending generally upwardly and forwardly from the lower portion 40 of the rear wall 26, approximating the general L-shape of the side elevation outline of the upper portion or instep of a conventional skate, e. g., the skates S1 and S2 of FIG. 1. This results in the rear wall 26 having a generally concave central area 42 extending between the upper rear edge 38 of each side wall 18 and 20.

This specific shaping of the present pack 10 is beneficial in the carriage of articles thereby, as the relatively wide bottom portion has a relatively larger volume than the upper portion of the central container 12, thus distributing any load carried therein lower in the pack 10 and accordingly lower on the body of the person carrying the pack 10, for better balance. Also, it will be noted that skates (ice skates or in line skates, such as the skates S1 and S2) have their heaviest structure located below the sole of the integral shoe or boot portion of the skate, with the upper portion of the shoe or boot being the lightest weight portion of the skate. Accordingly, the carriage of skates such as the in line skates S1 and S2 with their shapes generally conforming to the general lateral shape of the pack 10, as shown in FIG. 1, places the heaviest structure of the skates adjacent the bottom edges 28 of the side walls 18 and 20, thereby further lowering the center of gravity of the pack 10 and load carried thereon.

The central compartment 12 of the present back pack 10 includes a pair of spaced apart adjustable shoulder straps 44 and 46 extending from the top wall 24 adjacent the front wall 16, downwardly to the bottom wall 22 adjacent the front wall 16. These shoulder straps 44 and 46 are each openable and adjustable by means of a buckle or latch 48, one of which is shown in FIG. 4. Padding may be added to the straps 44 and 46 for greater comfort, if so desired.

A hip support belt 50, the right half of which is shown in the various drawing figures, may also be provided to relieve some of the load carried by the shoulder straps 44 and 46, if desired. The belt 50 extends from the first side wall 18 to the second side wall 20, from the lower portions thereof adjacent the front wall 16 and bottom wall 22 of the central compartment 12. The belt 50 is openable and adjustable by means of a buckle or latch 52, shown in FIG. 4. As in the case of the shoulder straps 44 and 46, padding may be provided for the belt 50 for greater comfort, if so desired.

Each of the side walls 18 and 20 includes some means for the carriage of a single skate thereon, as shown in FIG. 1. A skate support strap 54 is affixed to each side of the central compartment 12, extending respectively from the first and said second side wall 18 and 20 adjacent the forward wall 16, downwardly and rearwardly across each respective side wall 18 and 20 to the first and second side wall adjacent the bottom wall 22. While only one skate support strap 54 is shown in the drawing figures, it will be understood that the present back pack 10 is generally laterally symmetrical, and that a left side skate support strap 54 identical to the right side skate support strap 54 shown in the drawings, is provided on the left side of the pack 10.

A series of openable and adjustable skate securing straps is also provided, each having a first or upper end **56*a* extending from the first and second side walls 18 and 20 adjacent the rear wall 26, and a complementary second or lower end 56*b* extending from the two skate support straps 54 (or from a point above the support straps 54, adjacent the front wall 16). The straps 56*a* and 56*b* connect with one another by means of adjustable buckles or latches to secure the skates S1 and S2 externally to the sides of the pack 10 for storage and carriage thereon, as shown in FIG. 1**. Other strap connection means may be used if desired, such as mating hook and loop fastening means (e. g.,VELCRO), etc.

Further means for the external carriage of articles is provided by the external helmet storage and carriage area on the rear wall 26 of the central compartment 12. A helmet securing panel 58 is removably and adjustably attachable to the rear wall 26 of the central compartment 12, by means of a plurality of openable and adjustable straps disposed about the periphery of the helmet securing panel 58. Each strap has a first end **60*a* extending from the helmet securing panel 58, and a second end 60*b* extending from the periphery of the rear wall 26. The respective ends 60*a* and 60*b* may be secured together by buckles or other means as desired to secure the helmet securing panel 58 (and a helmet H which may be placed thereunder) removably to the outside of the rear wall 26, as shown in FIGS. 1 and 2. A supplementary group of straps 62 may be provided in the center of the rear wall 26 if desired, as shown in FIG. 2 with the helmet securing panel 58 removed from the rear wall 26, for the carriage of another article (water bottle, etc.) as desired. The helmet securing panel 58 itself preferably has a generally circular configuration, with a flexible periphery 64 across which a net 66 is adjustably drawn, for adjusting the fit of the helmet securing panel 58** over a helmet H.

It will be seen that the present back pack 10 may include further modifications (additional compartments, etc.) than those discussed above and shown in FIGS. 1 and 4. For example, an expandable bottom compartment 68, having a removable and interchangeable lower portion 70, may be provided below the bottom wall 22, if desired. The lower portion 70 may be formed in various sizes as desired, to provide any practicable volume desired for this bottom compartment 68. A plurality of straps having first ends **72*a* extending from the lower portion 70 of the bottom compartment 68 (FIG. 3) and opposite second ends 72*b* extending from the periphery of the bottom wall 22 of the central portion 12 (FIG. 2), provides further security for the bottom compartment 68 and any articles contained therein or secured thereto. FIG. 2 also shows the lower portion 70 of the bottom compartment 68, removed from the remainder of the pack 10**.

It will be noted that a relatively small, rearwardly disposed compartment is also shown in the various draining figures. In FIGS. 1, 3, and 4, this rearward compartment is a double unit (as indicated by the double zipper closure), and is designated as compartment 74, while in FIG. 2, the single rearward compartment has only a single closure and is designated as compartment 76. Other arrangements may be used as desired.

Additional smaller compartments may be added as desired, such as the top compartment 78 (FIGS. 1 and 4) immediately behind the handle 80, and/or a compartment 82 which is removably attachable to one or the shoulder straps 44 or 46, as shown in FIG. 4.

In summary, the present back pack for in-line skates 10 will be seen to provide a most useful means for the carriage and temporary storage of equipment used in in-line skating. The relatively large central compartment 12 provides for the internal storage of various relatively large and bulky articles, such as elbow and knee guards, or perhaps a change of clothing, etc., while the large and bulky skates S1 and S2 and helmet H are carried externally on the pack 10, as described above and illustrated in the drawing figures. The configuration of the present pack 10, with its concave and sloping rear wall 26, is optimally adapted for the carriage of articles having an approximate L shape, such as skates with high tops, boots, etc., and places the heaviest portions of these articles at the lowest area of the pack, to provide the lowest center of gravity possible for better balance. Smaller volume supplementary pouches or containers may be added to the present pack 10 as desired, and may be made to be expandable by means of interchangeable portions thereof, or otherwise provided with additional utility (double compartments, external straps, etc.). While the present pack 10 is particularly well suited for the carriage of in-line skates and articles associated therewith, it will also be seen to be of great value to the ice skater or other person needing to carry skates, boots, or similarly shaped articles.

It is to be understood that the present invention is not limited to the sole embodiments described above, but encompasses any and all embodiments within the scope of the following claims.

I claim:

1. A back pack for in-line skates, comprising:

a large central compartment having an accessible internal volume defined by a front wall, a first and an opposite second side wall, a bottom wall, a top wall opposite said bottom wall, and a rear wall opposite said front wall;

said central compartment including a pair of spaced apart adjustable shoulder straps extending from said top wall adjacent said front wall to said bottom wall adjacent said front wall;

each said side wall including means for removably securing and externally carrying a single skate thereon, said means for securing and carrying a skate on each said side wall comprises a fixed first and second lower skate support strap extending respectively from said first and said second side wall adjacent said forward wall, downwardly and rearwardly across each respective said side wall to said first and said second side wall adjacent said bottom wall, and a plurality of openable and adjustable skate securing straps each having a first end extending from said first and said second side wall adjacent said rear wall and an opposite second end, for securing the skates externally to said back pack; and said rear wall including means for removably securing and externally carrying a helmet thereon.

2. The back pack according to claim 1, wherein said means for securing and carrying a helmet on said rear wall comprises a helmet securing panel attached to said rear wall by a plurality of openable and adjustable straps for attaching said helmet securing panel over the helmet, for securing the helmet between said helmet securing panel and said rear wall of said central compartment.

3. The back pack according to claim 2, wherein said helmet securing panel is removable from said rear wall of said central compartment and comprises a net adjustably disposed across a flexible periphery.

4. The back pack according to claim 1, including an openable and adjustable hip belt extending from said first side wall to said second side wall adjacent said front wall and said bottom wall of said central compartment.

5. The back pack according to claim 1, including at least one additional compartment extending from said central compartment.

6. The back pack according to claim 5, wherein said at least one additional compartment comprises an expandable bottom compartment disposed over said bottom panel of said central compartment.

7. A back pack for in-line skates, comprising:

a large central compartment having an accessible internal volume defined by a front wall, a first and an opposite second side wall, a bottom wall, a top wall opposite said bottom wall, and a rear wall opposite said front wall;

each said side wall having a generally straight bottom edge and front edge and having a short top forward edge and lower rear edge, with an upper rear edge having a generally concave shape and extending generally upwardly and forwardly from said lower rear edge to said top forward edge, with each said side wall thus having a generally L shaped configuration approximating the side elevation outline of a conventional in line skate and said rear wall having a generally concave central area extending between said upper rear edge of each said side wall;

means for removably securing and externally carrying a single skate on each said side wall;

said central compartment including a pair of spaced apart adjustable shoulder straps extending from said top wall adjacent said front wall to said bottom wall adjacent said front wall;

an openable and adjustable hip belt extending from said first side wall to said second side wall adjacent said front wall and said bottom wall of said central compartment; and at least one additional compartment extending from said central compartment.

8. The back pack according to claim 1, wherein said means for securing and carrying a skate on each said side wall comprises a a fixed first and second lower skate support strap extending respectively from said first and said second side wall adjacent said forward wall, downwardly and rearwardly across each respective said side wall to said first and said second side wall adjacent said bottom wall, and a plurality of openable and adjustable skate securing straps each having a first end extending from said first and said second side wall adjacent said rear wall and an opposite second end, for securing the skates externally to said back pack.

9. The back pack according to claim 7, including means for removably securing and externally carrying a helmet on said rear wall.

10. The back pack according to claim 9, wherein said means for securing and carrying a helmet on said rear wall comprises a helmet securing panel attached to said rear wall by a plurality of openable and adjustable straps for attaching said helmet securing panel over the helmet for securing the helmet between said helmet securing panel and said rear wall of said central compartment.

11. The back pack according to claim 10, wherein said helmet securing panel is removable from said rear wall of said central compartment and comprises a net adjustably disposed across a flexible periphery.

12. The back pack according to claim 7, wherein said at least one additional compartment comprises an expandable bottom compartment disposed over said bottom panel of said central compartment.

13. A back pack for in line skates and a pair of skates and a helmet, comprising in combination:

a back pack including a large central compartment having an accessible internal volume defined by a front wall, a first and an opposite second side wall, a bottom wall, a top wall opposite said bottom wall, and a rear wall opposite said front wall;

said central compartment including a pair of spaced apart adjustable shoulder straps extending from said top wall adjacent said front wall to said bottom wall adjacent said front wall;

each said side wall including means for removably securing and externally carrying a single skate of a pair of skates thereon; and said rear wall including means for removably securing and externally carrying a helmet thereon.

14. The back pack according to claim 13, wherein said means for securing and carrying said skate on each said side wall comprises a fixed first and second lower skate support strap extending respectively from said first and said second side wall adjacent said forward wall, downwardly and rearwardly across each respective said side wall to said first and said second side wall adjacent said bottom wall, and a plurality of openable and adjustable skate securing straps each having a first end extending from said first and said second side wall adjacent said rear wall and an opposite second end, for securing the skates externally to said back pack.

15. The back pack according to claim 13, wherein said means for securing and carrying said helmet on said rear wall comprises a helmet securing panel attached to said rear wall by a plurality of openable and adjustable straps for attaching said helmet securing panel over said helmet for securing said helmet between said helmet securing panel and said rear wall of said central compartment.

16. The back pack according to claim 15, wherein said helmet securing panel is removable from said rear wall of said central compartment and comprises a net adjustably disposed across a flexible periphery.

17. The back pack according to claim 13, including an openable and adjustable hip belt extending from said first side wall to said second side wall adjacent said front wall and said bottom wall of said central compartment.

18. The back pack according to claim 13, including at least one additional compartment extending from said central compartment.

* * * * *